US005253844A

United States Patent [19]

Cotic et al.

[11] Patent Number: 5,253,844

[45] Date of Patent: Oct. 19, 1993

[54] HAIRPIN SPIKE PULLING TOOL AND MACHINE THEREFOR

[75] Inventors: Dennis J. Cotic; Jack K. Hosking, both of Waukesha, Wis.

[73] Assignee: Oak Industries, Inc., Waltham, Mass.

[21] Appl. No.: 863,826

[22] Filed: Apr. 6, 1992

[51] Int. Cl.[5] ..... B25C 11/00

[52] U.S. Cl. ..... 257/18; 254/22; 254/131

[58] Field of Search ..... 254/18, 21-24, 254/30, 131, 132; 29/225, 243.56; 294/88, 106

[56] References Cited

U.S. PATENT DOCUMENTS

| | | | |
|---|---|---|---|
| 898,064 | 9/1908 | Rittersbach, Jr. | 254/18 |
| 925,557 | 6/1909 | Bramstodt | 254/18 |
| 1,771,712 | 7/1930 | Jimerson | 254/18 |
| 1,893,719 | 1/1933 | Talboys | 254/18 |
| 2,691,505 | 10/1954 | Hursh | 254/18 |
| 3,883,118 | 5/1975 | Miller | 254/18 |

*Primary Examiner*—Bruce M. Kisliuk
*Assistant Examiner*—Eileen P. Morgan
*Attorney, Agent, or Firm*—Welsh & Katz, Ltd.

[57] ABSTRACT

A machine for removing hairpin spikes from railroad ties includes at least one hairpin spike pulling tool supported by the machine frame, each tool being positioned on one side of the rail for pulling spikes on that side of the rail. Each of the pulling tools includes a lower end portion having a pair of exposed hooks curved toward the center of the pulling tool and abutted against each other in a pivoting relationship. Each pulling tool is supported for movement from a retracted position to a position wherein the curved hooks of that pulling tool are positionable under the loop-shaped head of a hairpin spike on opposite sides of the spike. The machine also includes apparatus for supporting the pulling tools for movement from the retracted position downwardly and toward the hairpin spikes into a position wherein the pulling tools engage the spikes with the curved hooks and then move upwardly to pull the spikes from the tie.

13 Claims, 7 Drawing Sheets

HAIRPIN SPIKE PULLING TOOL AND MACHINE THEREFOR

FIELD OF THE INVENTION

The present invention relates to machines for use in the maintenance of railroad track and, more particularly, to apparatus for use in removing spikes from railroad ties. In particular, the present invention relates to a hairpin spike pulling device.

BACKGROUND OF THE INVENTION

Maintenance of railroad track and replacement of railroad ties requires the removal of spikes from the ties to permit separation of the track from the ties and the positioning of new ties. Removal of the spikes is also required to permit replacement of worn or damaged rails or replacement of joined rails with continuous lengths of rail welded together.

One of the prior art methods for use in removing the spikes from the ties and ties plates requires the use of a pry bar having a split claw on one end, and conventional spikes having an offset head are manually pried out of the ties by means of this tool.

Machines have also been constructed for mechanically pulling such spikes out of the ties. Such machines commonly include a clamping assembly, including a pair of jaws movable toward and away from each other and operable to grip the offset head of the tie spike. Mechanical structure is provided for then lifting the clamping assembly so that the spike is pulled from the tie and the tie plate. This lifting structure can be either a hydraulic cylinder or a mechanical lifting device.

One of the problems with such prior art spike pulling machines is that in many cases two operators are required, one to operate and guide the clamping device on one side of the rail and another operator to guide the clamping device on the other side of the rail. Another problem with the prior art spike pullers is that they are not designed to pull hairpin spikes, but are only designed to pull conventional spikes having an offset head.

Hairpin spikes have a head consisting of a metal loop defining a loop-aperture, which is above the surface of the tie and the tie plate, with a shank consisting of two legs which are embedded in the tie. Such spikes currently must be removed from the tie by the use of a manual pry bar having a hook on the end which fits through the loop-aperture of the hairpin spike. Attempts at automating the removal of hairpin spikes have resulted in relatively cumbersome machines requiring separate powered mechanisms for grasping the spike and for holding the spike during withdrawal.

Accordingly, it is an object of the present invention to provide an improved spike pulling tool for removing hairpin spikes from a railroad tie.

It is another object of the present invention to provide a hairpin spike pulling tool which may be integrated with a spike pulling machine for removing hairpin spikes from railroad ties in a facile manner.

It is a further object of the present invention to provide a hairpin spike pulling tool which can be machine operated to grip the loop-shaped head of the hairpin spike with no manual assistance by the machine operator, or by others in the track repair crew.

It is yet another object of the present invention to provide a hairpin spike pulling tool which is readily interchangeable with conventional spike pulling tools on a conventional spike pulling machine.

It is still another object of the present invention to provide a hairpin spike pulling tool which grasps and holds the spike without supplemental power mechanisms.

These and other objects of the invention, as well as the advantages thereof, will become more clear from the disclosure which follows.

SUMMARY OF THE INVENTION

The foregoing objectives are accomplished by a hairpin spike pulling tool which is suitable for use in removing a railroad hairpin spike out of a railroad tie supporting a rail, where the hairpin spike includes a loop shaped head defining a loop-aperture above the surface of the railroad tie. The pulling tool is provided with a housing for mounting the tool to a machine for pulling spikes, and is designed to be loosely mounted to a lower end of each of a pair of pivotable support arms located on a spike pulling machine.

The present hairpin spike pulling tool also includes first and second scissors elements each having a hook at a lower end, the elements being engaged in the housing and configured for pivotal movement relative to each other so that the hooks are abutted against each other and are movable for engaging the loop-shaped head of the hairpin spike.

More specifically, each pulling tool includes a housing face plate having a front surface and a back surface, and a housing back plate having a back surface and a front surface spaced from the back surface of the housing face plate by a plurality of spaced bearing pins. The pins extend from the front face of the housing back plate and include an upper central bearing pin including a front face, a lower right bearing pin including a front face, and a lower left bearing pin including a front face. The face plate back surface is held abutted against each bearing pin front face to thereby provide a confined space between the face plate back surface and the back plate front surface.

The confined space between the face plate and the back plate includes a front scissors element pivotally engaged with a rear scissors element within the confined space and further confined by the bearing pins. Each scissors element includes an elongated arm terminating at its lower end in a hook curving toward the center of the face plate. One of the scissors elements is secured within the confined space by having a portion of the upper length of its arm loosely extending between and above the upper central bearing pin and the lower left bearing pin. The other scissors element is secured within the confined space by having a portion of the upper length of its arm loosely extending between and above the upper central bearing pin and the lower right bearing pin.

The lower end of each arm projects below the face plate so that the curved hooks are abutted against each other below the center of the face plate in the closed position. Due to the loose fit of the scissors elements between the bearing pins, a lifting force applied by the support arms will cause the scissors elements to then be freely abutted against each other within the loop-aperture of the hairpin spike head, so that raising the spike pulling tool cause the abutted curved hooks to then pull upon the hairpin spike out of the railroad tie in which it is secured. The subsequent opening of the hooks releases the pulled spike. Spike release may be accomplished in various ways, the simplest of which is to "bounce" the withdrawn spike upon the ground, through manipulation of the support arm, thus opening the hooks.

In one embodiment, the uppermost ends of each of the arms are connected to a corresponding end of a hydraulic cylinder and piston assembly which opens the hooks upon operator command. In the open position, the hooks more easily engage the loop-aperture of a hairpin spike. A spring biases the hydraulic cylinder assembly to the return or closed position to grasp the next spike.

Another mechanism for effecting spike release includes the provision of outwardly projecting upper ends to at least one of the scissors elements. A tool release bracket is mounted to the frame of the spike pulling machine and is provided with at least one generally horizontally projecting arm for engaging the upper ends of at least one scissors element as the tool is raised with the withdrawn spike The impact of the scissors elements upon the bracket causes the hooks to separate, releasing the spike.

Yet another spike release mechanism includes a cable and pulley system wherein a cable is connected between the upper end of at least one scissors element and the frame of the spike pulling machine. The cable is passed around a pulley wheel located on a movable support arm bearing the spike pulling tool. As the support moves to pull the spike from the tie, the cable is drawn taut, pulling on the scissors element and separating the hooks, and releasing the spike.

A further embodiment of the present invention comprehends a hairpin spike pulling machine, suitable for use in removing a railroad hairpin spike out of a railroad tie supporting a rail, wherein the hairpin spike includes a loop-shaped head defining a loop-aperture above the surface of the railroad tie. The machine includes a machine frame and wheels for supporting the machine frame for movement along railroad tracks. An engine is supported by the machine frame for driving at least one of the wheels, and for supplying power to machine elements for pulling hairpin spikes from the railroad ties.

At least one hairpin spike pulling tool, as hereinabove defined, is supported by the machine frame, one such pulling tool being positioned on one side of the rail for pulling spikes on that side of the rail. Each pulling tool includes a lower end portion having a pair of exposed hooks, curved towards the center of the pulling tool and abutted against each other in a free pivoting relationship for moving apart.

Additionally, each pulling tool is supported for movement from a retracted position to a position wherein the curved hooks of that pulling tool are positionable under the loop-shaped head of a hairpin spike on opposite sides of the spike. Structure is provided for supporting the pulling tools for movement from the retracted position generally downwardly on a pivot arc and toward the hairpin spikes, into a position wherein the pulling tools engage the spikes with the curved hooks and then move generally upwardly along that same pivot arc to pull the spikes from the tie.

A clearer understanding of the present invention will be obtained from the disclosure which follows, when read in light of the accompanying drawings.

DESCRIPTION OF THE PREFERRED EMBODIMENTS

Figures 1, 2, 3:
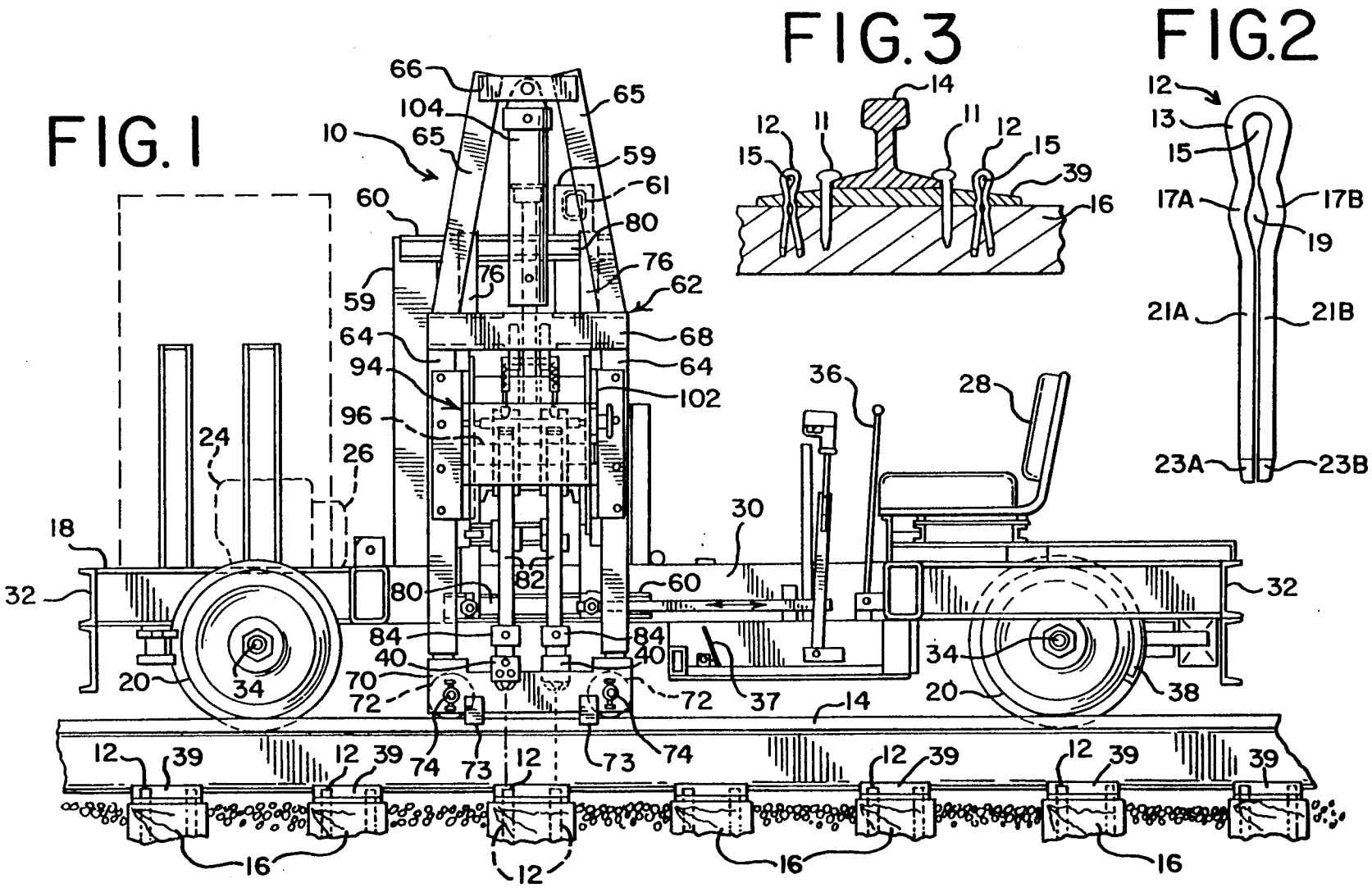
FIG. 1 is a simplified schematic representation of a hairpin spike pulling machine shown in a side elevational view.
FIG. 2 is a simplified schematic representation of hairpin spike shown in a front elevational view.
FIG. 3 is a simplified schematic representation shown partially in section, which illustrates a rail secured to a tie plate by means of conventional offset head spikes, and a tie plate secured to a railway tie by means of the shank of the offset head spikes and a pair of hairpin spikes which are embedded in the tie.

Referring now to FIG. I, a spike pulling machine is generally designated 10. It is contemplated that the machine 10 is self-propelled, however, manual spike pulling devices, or other types of railroad maintenance equipment may also be equipped with the present invention. The machine 10 is designed, depending on the spike-pulling tool provided, for use in pulling both conventional offset spikes as well as hairpin spikes from railroad ties to provide for removal of rails 14 and replacement of worn rails 14 or worn ties 16. The machine 10 includes a frame 18 supported on the rails 14 by a plurality of flanged wheels 20. The frame 18 supports a conventional internal combustion engine 24 (shown hidden) and conventional apparatus is provided for drivingly connecting the engine 24 to at least one of the wheels 20 for driving the machine 10 along the rails. The machine also includes a conventional hydraulic pump 26 driven by the engine 24 and providing hydraulic fluid pressure for operating hydraulically driven devices of the machine 10. The machine 10 also includes an operator's seat 28 disposed on a rearward portion of the frame 18 for use by a single operator.

Referring now to FIG. 2, a typical hairpin spike, which is to be pulled from the railway tie by the machine 10 of FIG. 1, is designated at 12. The railway spike 12 has a loop-shaped head 13 defining an upper aperture 15. Below the loop-shaped head are a pair bowed hip elements, 17A and 17B, which define a lower aperture 19. The hip elements 17A, 17B continue downwardly as a pair of elongated narrow legs 21A, 21B which terminate in bevelled or sharpened toe elements or ends 23A, 23B. It is to be noted that there is an elongated space confined between the elongated narrow legs 21A, 21B.

The pair of bowed hip elements 17A, 17B are compressed when the hairpin spike 12 is driven through an aperture in a tie plate so that the bevelled or sharpened ends 23A, 23B penetrate into the wood of the railway tie at an angle. As the spike is driven downwardly and the bowed hip elements 17A, 17B pass through the aperture of the tie plate, they are compressed inwardly so that the lower aperture 19 is compressed in width, thereby causing the elongated narrow legs 21A, 21B to be sprung outwardly at a diverging angle in order to thereby more securely lock the hairpin spike into the wood of the railway tie.

FIG. 3 illustrates a conventional rail, tie plate, railway tie, and spike configuration in a normal installation. FIG. 3 shows the rail 14 sitting upon a tie plate 39, with the tie plate sitting upon the tie 16. Conventional offset head railway spikes 11 are driven through the tie plate inner apertures and into the railway tie 16 in a manner sufficient to provide that the offset of the head will securely pin the bottom support flange of the rail 14 against the top of the tie plate 39, while the shank of the spike is embedded in tie 16 to secure the tie plate to the tie.

The hairpin spikes 12 are driven through tie plate outer apertures to thereby further secure the tie plate 39 to the railway tie 16. It will be seen in FIG. 3 that the elongated narrow legs 21A, 21B of each hairpin spike have been diverged as they were driven into the wood of the railway tie. It will also be seen that the upper apertures 15 of the hairpin spikes 12 are oriented so that the axis of each loop-aperture 15 is substantially parallel to the longitudinal axis of the rail. This orientation of the hairpin spikes 12 is an essential aspect for the proper functioning of the self-propelled spike pulling machine 10 and the hairpin spike pulling tool 40, which will be discussed more clearly hereinafter.

Referring once again to the specific configuration illustrated in FIG. 1, the structure and operation of the machine 10 is described in detail in commonly-assigned U.S. Pat. No. 4,538,793, which is incorporated by reference herein. The frame 18 of the hairpin spike pulling machine 10 is rectangular and includes a pair of beams 30 joined at their opposite ends by cross-beams 32. The beams 30 are supported by axles 34, and the wheels 20 are rotatably mounted on the opposite ends of the axles 34. The wheels 20 ride on the rails 14 and support the machine for movement along the railroad track.

During operation of the machine 10, the operator controls movement of the machine along the track with a propulsion valve control lever 36 and a brake pedal 37. The propulsion valve control lever 36 is connected to the engine 24 in a conventional manner so that forward movement of the upper end of the propulsion valve control lever 36 will cause the machine to be driven forwardly. The brake pedal 37 is connected to a brake shoe 38 and is operable to control braking of the machine 10.

The spike pulling machine 10 also includes a pair of hairpin spike pulling tools 40, one positioned on one side of the rail 14 and the other positioned on an opposite side of the rail, the spike pulling tools 40 being supported so that they ca simultaneously engage spikes 12 on opposite sides of the rail 14 and pull these spikes 12 out of the tie plates 39 and ties 16.

An assembly is also provided for supporting the tools 40 for preferably pivoting movement from a retracted position to a position wherein the lower ends of the tools can engage spikes 12 on opposite sides of a rail 14, and then to a position wherein the tools 40 pull the spikes 12 upwardly out of the tie and tie plate. A generally vertically extending frame structure fixedly supported by the machine frame 18 extends upwardly from a central portion of the machine frame. In the illustrated arrangement, the vertically extending frame structure is defined by a plurality of upwardly extending beams 59, two of the beams 59 being joined at their upper ends by a cross member 61. The upwardly extending beams 59 also fixedly support a pair of horizontally extending tracks or channels 60. The tracks 60 are vertically spaced apart with respect to one another.

The machine 10 also includes a horizontally reciprocal second frame 62. While the second frame 62 could be constructed in various ways, in the illustrated arrangement, the second frame 62 has a generally "A" frame configuration and includes a pair of vertically extending frame members 64. The upper ends 65 of the vertically extending frame members 64 converge and are joined at their upper ends by connecting bars 66.

The vertically extending frame members 64 are joined intermediate their opposite ends by a cross member, not shown, and are rigidly joined together at their lower ends by a base member 70. The second frame 62 is supported so that the base member 70 is positioned immediately above the rail 14 and parallel to the longitudinal axis of the rail 14. The second frame 62 extends upwardly from the rail 14 and defines a vertical plane including the longitudinal axis of the rail 14.

The second frame 62 is supported for movement along the rail 14. In the illustrated construction, the base member 70 includes a hollow box beam open at its opposite ends. The, opposite ends each house a roller or wheel 72 supported by shafts 74 and adapted to rest on the upper surface of the rail 14 and roll along the rail to support the second frame 62. Guides 73 extend downwardly from opposite sides of the base member 70 and are positioned on opposite sides of the rail 14 to maintain alignment of the second frame 62 on the rail.

In the machine 10, the hairpin pulling tools 40 are supported to be freely reciprocally movable with respect to the machine frame 18, and horizontally forwardly and rearwardly in the direction of the rails 14. The structure providing such horizontal reciprocal movement permits adjustment of the position of the tools 40 with respect to the spikes 12 without requiring movement of the entire machine 10 into accurate alignment with the spikes 12.

Figure 7:
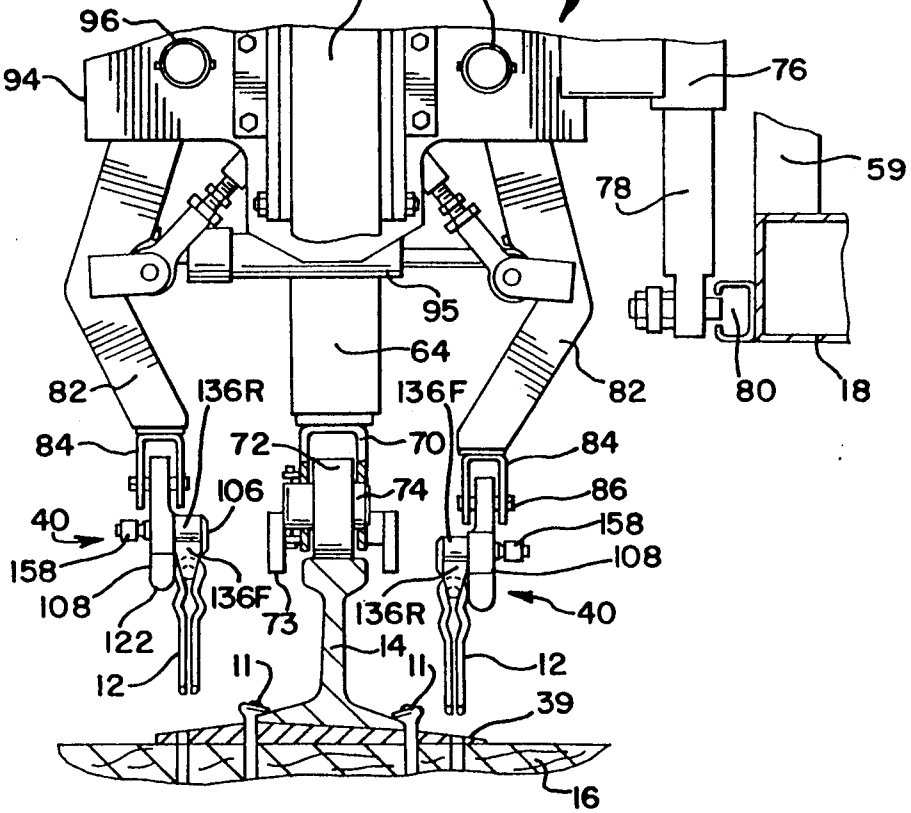
FIG. 7 is an enlarged partial front elevational view of the hairpin spike pulling machine of FIG. 1, showing the hairpin spike pulling tools pulling spikes from the tie.

The above-identified structure supporting the tools 40 for adjustable movement includes a pair of spaced vertically extending tubes or sleeves 76 which each slidingly engage a corresponding spaced, vertically extending shaft 78 (best seen in FIG. 7). The sleeves 76 surround the vertically extending shafts 78 and are supported thereon by sleeve bearings, not shown, for vertical reciprocal movement between a raised position as shown in FIG. 1, and a lowered position (not shown).

The upper ends of the sleeved shafts 78 are supported by a slide block 80 supported for slidable movement in the upper track 60, and the lower ends of the shafts are similarly supported by a slide block 80 housed in the lower horizontally extending track or channel 60 supported by the machine frame 18. The vertically extending shafts 78 are supported for limited reciprocal horizontal movement by the slide blocks 80 to provide for adjustable positioning of the tools 40 with respect to the spikes 12.

Referring now to FIGS. 1 and 7, a pair of pivotable support arms 82 are provided for supporting the hairpin spike pulling tools 40. The lower end of each of the support arms 82 defines a clevis 84 adapted to house the planar upper portion of the pulling tools 40. The two sides of each clevis 84 include bores, and the upper portion of each of the tools 40 includes a matching bore. A pin 86 is thus adapted to extend through each clevis to loosely secure the pulling tools 40 to the support arms 82.

In a preferred form of the invention, each clevis 84 will support a tool 40 so that it is freely pivotable or moveable about the axis of the clevis pin 86 and the bore in the upper portion of the tool 40 will permit limited shiftable movement of the tool 40 with respect to the clevis 84. Accordingly, the tool 40 is relatively loosely supported so that the pulling tool can align itself with the hairpin spike 12 as it is moved into engagement with the spike.

The upper ends of the support arms 82 are pivotally joined to a support block 94. The support block 94 comprises a generally hollow box-like structure which is open at the top and bottom. The support block 94 includes a pair of spaced vertical side walls and a pair of vertical end walls joining the side walls. The sidewalls are also joined by a connecting beam extending between and rigidly joining upwardly extending portions of the side walls. The support block 94 is rigidly joined to the tubes 76 by a pair of connecting members welded to the tubes 76 and welded to the end wall. The support block 94 is thus supported for vertical reciprocal movement and horizontal adjusting movement with the tubes or sleeves 76.

The arms 82 are pivotally joined to the support block 94 by pivot rods or shafts 96 (best seen in FIG. 7) extending through the upper end of the support block 94 and with opposite ends of the pivot shafts 96 journaled in bores in the side walls of the support block 94. The pivot shafts 96 are held in place with respect to the support block 94 by pins extending through opposite ends of the shaft 96. The support arms 82 are supported so that the hairpin spike pulling tools 40 supported by the arms 82 can be moved toward and away from each other and toward and away from the rail 14. This arcuate movement is accomplished under the control of a hydraulic cylinder 95 (best seen in FIG. 7).

A guide assembly is also provided for supporting the support block 94 for vertical reciprocal movement between the vertically extending frame members 64 of the second frame 62. While various structures could be provided for maintaining this alignment, in the illustrated arrangement the second frame 62 includes a pair of integral vertically extending linear guides supported by the opposed surfaces of the vertical frame members 64 and adapted to be slidably housed between pairs of vertically extending tracks 102 of the support block 94.

A hydraulic cylinder 104 is provided for causing selective vertical reciprocal movement of the support block 94, the support arms 82, and the pulling tools 40 with respect to the rails 14 and the second frame 62. In the illustrated construction, the hydraulic cylinder 104 has one end pivotally joined by a pin to the connecting bars 66 of the second frame 62. The cylinder rod extends downwardly from the lower end of the cylinder 104 and has a lower end pivotally connected by a pin to a flange extending upwardly from the connecting beam of the support block 94. The cylinder 104 is operable to cause vertical reciprocal movement of the support block 94 with respect to the second frame 62, thereby moving support arms 82 up and down.

Figure 4:
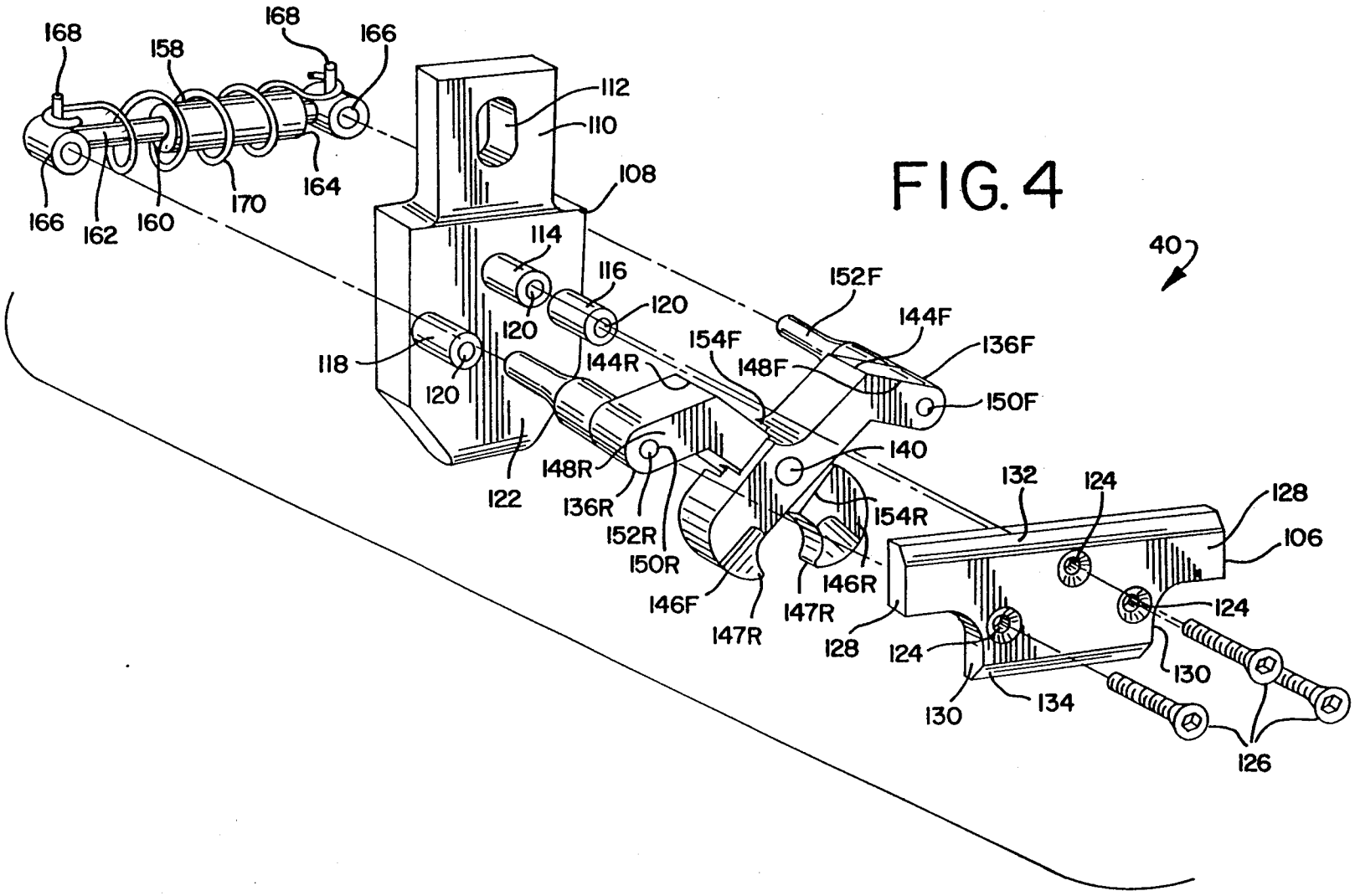
FIG. 4 is an exploded front perspective view of a hairpin spike pulling tool of the present invention.

The structure of the hairpin spike pulling tool 40 is shown in FIG. 4, which is an exploded perspective view. The pulling tool 40 has a housing face plate 106 and a housing back plate 108 which is preferably provided with a flat bracket 110 as an integral attachment. An aperture 112 is located in the flat bracket 110 for passage of the pin 86 of the clevis 84, so that the hairpin pulling tool 40 may be secured to the vertically reciprocating support arm 82 of the machine 10. In the preferred embodiment, the aperture 112 is vertically elongated to allow for extra clearance and movement of the tool 40 in the clevis 84.

The front surface of the housing back plate 108 has an upper central cylindrical bearing pin 114, a lower right cylindrical bearing pin 116, and a lower left cylindrical bearing pin 118 extending therefrom. Each of the bearing pins, 114, 116, 118 defines an internally threaded bore 120. A lower end 122 of the housing back plate 108 has a tapered shape for clearing adjacent spikes or other obstacles, and is also configured to act as a backstop as will be described below.

The housing face plate 106 contains a plurality of, and preferably three mounting throughbores 124, each disposed to be concentric with a corresponding one the bearing pins 114, 116, 118 when the tool 40 is assembled. These throughbores 124 are preferably internally threaded to engage a fastener 126 therein. The fasteners 126 are preferably threaded and may be screws, bolts or other types of conventional fasteners. The fasteners 126 are tightened until the back face of the housing face plate 106 is tightly abutted against at least two of the circular end faces of the bearing pins 114, 116, and 118, but preferably against all three. A laterally extending guard formation or wing 128 is integrally formed on each side 130 of the face plate 106. Also, in the preferred embodiment, the upper and lower edges 132, 134 of the front face of the housing face plate 106 are beveled.

The confined space between the housing face plate 106 and the housing back plate 108 contains a front scissors element 136F and a rear scissors element 136R which are freely pivotally secured together by a scissors pin element 140. The scissors pin element 140 may be a pin, a rivet, or a bolt with a nut secured thereto. The front scissors element 136F includes an arm 144F terminating in a curved hook 146F. The hook 146F is massive in configuration to accommodate lifting stresses and to prevent bending due to high loading forces.

Figure 6:
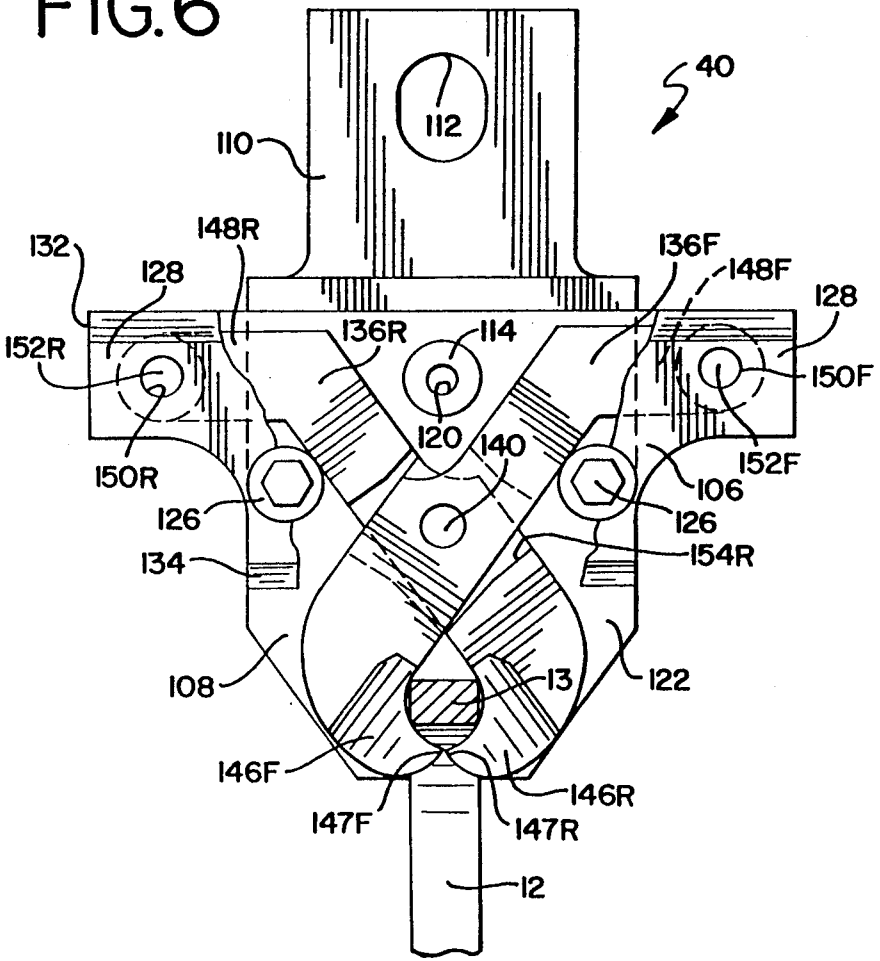
FIG. 6 is a view similar to FIG. 5, but showing the curved hooks of the scissors elements disposed together in the closed position for pulling the spike upwardly out of the tie.

An upper end portion 148F is angled relative to the linear axis of the front scissors element 36F to be generally horizontal when the tool 40 is in the closed position (best seen in FIG. 6). A throughbore 150F in the upper end portion . 148F is dimensioned to securely retain a spindle 152F therein. The spindle 152F may be welded, threaded, or otherwise secured within the throughbore 150F to extend rearwardly toward the back plate 108 in a generally horizontal position. A transverse channel cutout 154F is located in a rear surface of the front scissors element 136F.

The rear scissors element 136R is generally a mirror image of the front scissors element 136F, and corresponding elements will be designated with the subscript 'R'. Thus, the rear scissors element 136R includes an arm 144R, a hook 146R, an upper angled end 148R with a throughbore 150R into which a spindle 152R is secured to extend rearwardly. The hooks 146F, 146R are each provided with a relatively narrowed tip 147F, 147R for facilitating the engagement with the loop-shaped head 13 of the spike 12. Furthermore, the generally upwardly curving lower ends of each of the hooks 146F, 146R are configured for facilitating the location and engagement of spikes 12 by the tool 40. Specifically, the curved shape of the lower hook ends tends to position the head 13 of the spike centrally between the hooks 146F and 146R.

A transverse channel cutout 154R is located in a front face of the element 136R so that the elements 136F, 136R may be assembled on the pivot pin 140 in scissors engagement in the space between the face plate 106 and the back plate 108. Each scissors element 136F, 136R is loosely contained within the channel cutout portion 154 of the other scissors element, and the pivot pin 140 passes through each scissors element at the channel cutout portions to thereby provide that the two scissors elements are freely pivotable within the channel cutout portions. It will be seen from FIG. 4 that the width of the transverse cutout portions 154F, 154R is greater than the width of the scissors element arms 144F and 144R. This, together with the pivot pin 140, assures that the two scissors elements 136F and 136R are freely pivotable in relation to each other within the channel cutout portions.

The front scissors element 136F is secured within the confined space between the housing face plate 106 and the housing back plate 108 by having the upper length of its arm 144F loosely extending between and above the upper central bearing pin 114 and the lower right bearing pin 116. The rear scissors element 136R is secured within the confined space by having the upper length of its arm 144R loosely extending between and above the upper central bearing pin 114 and the lower left bearing pin 118.

If desired, a fluid power cylinder 158 may be disposed behind the back plate 108 in a generally horizontal orientation. The cylinder 158 is preferably of the single-acting hydraulic type, receives pressurized fluid through the action of the pump 26 and drains to a hydraulic reservoir (not shown) as is known in the art. In addition, the cylinder 158 has a rod end 160 provided with a piston shaft 162, and a blind end 164. Both the piston shaft 162 and the blind end 164 are each provided with a bore 166 configured to matingly and pivotally engage the spindles 152F, 152R. Each bore 166 includes an upwardly projecting peg 168 or equivalent structure for engaging a respective hooked end of a coiled return spring 170 which, when provided, helically circumscribes the cylinder 158. Other types of return devices are contemplated.

Figure 5:
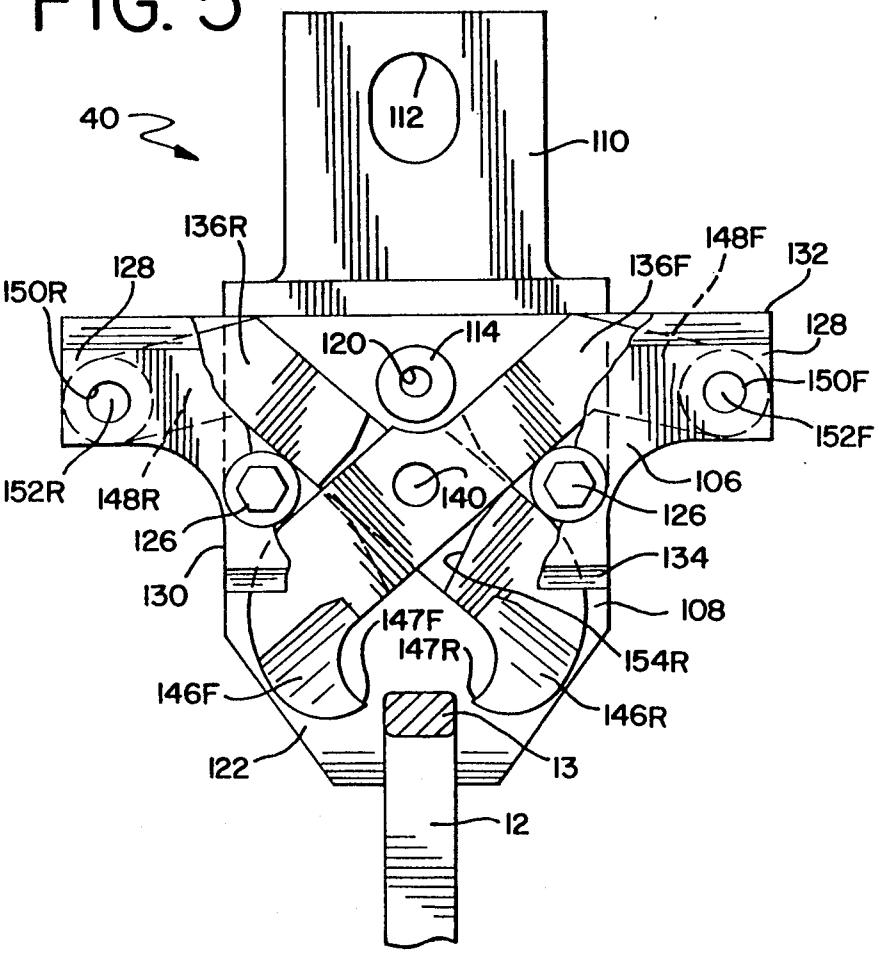
FIG. 5 is a front elevational view, with portions cut away for clarity, of the scissors elements of the hairpin spike pulling tool of FIG. 4 disposed in the open position with the hooks spaced apart for gripping the looped head of a hairpin spike.

When pressurized, the piston shaft 162 extends from the cylinder 158, and, through the pivotal mating relationship between the bores 166 and the spindles 152F and 152R, the scissors elements 136F and 136R are pivoted about the pin 140 to spread the hooks 146F, 146R into an open position (best seen in FIG. 5). Upon release of the pressure, the fluid in the blind end 168 of the cylinder 158 drains to tank, and the biasing force exerted by the spring 170 pulls the shaft 162 back into the cylinder 158. This action causes the scissors elements 136F and 136R to pivot about the pin 140 to cause the hooks 146F, 146R to contact each other and assume the closed position (best seen in FIG. 6).

Figure 8:
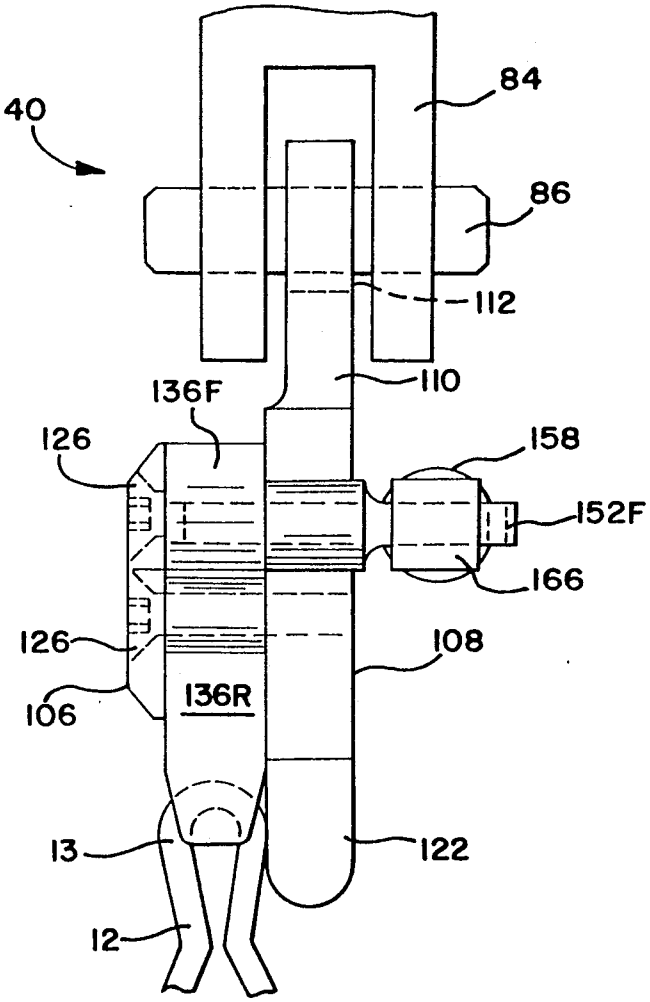
FIG. 8 is a side elevational view of the hairpin spike pulling tool shown in FIG. 6.

Referring now to FIGS. 5, 6 and 8, the lower end of each arm 144F and 144R projects below the face plate 106. Prior to initiation of the spike-pulling operation, the cylinder 158 is unpressurized, and the curved hooks 146F and 146R are normally abutted against each other below the center of the face plate 106 due the weight of the scissors elements 136F and 136R and their loose fit between the bearing pins. This normal, closed position is shown in FIG. 6.

The action of the machine 10 in extracting the spike 12 is the same when using the present hairpin spike pulling tool 40 as when using a conventional offset spike pulling claw as disclosed in U.S. Pat. No. 4,538,793. The only modification to the machine 10 to convert it from conventional spike pulling to hairpin spike pulling is to remove the standard spike puller claw from the clevis 84 and replace it with the tool 40 by removing and replacing the clevis pin 86 (best seen in FIG. 8).

Figure 10:
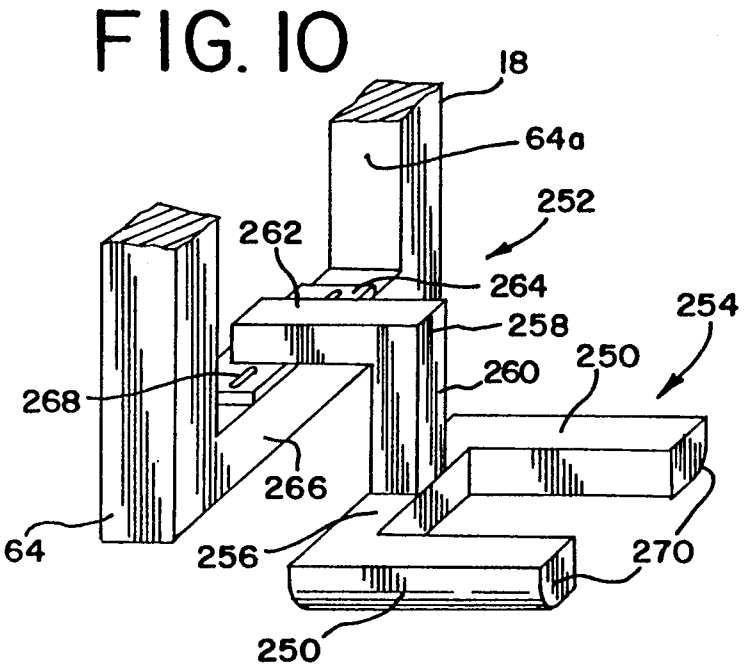
FIG. 10 is a top perspective elevational view of the tool release bracket used with the embodiment of FIG. 9.
Figure 9:
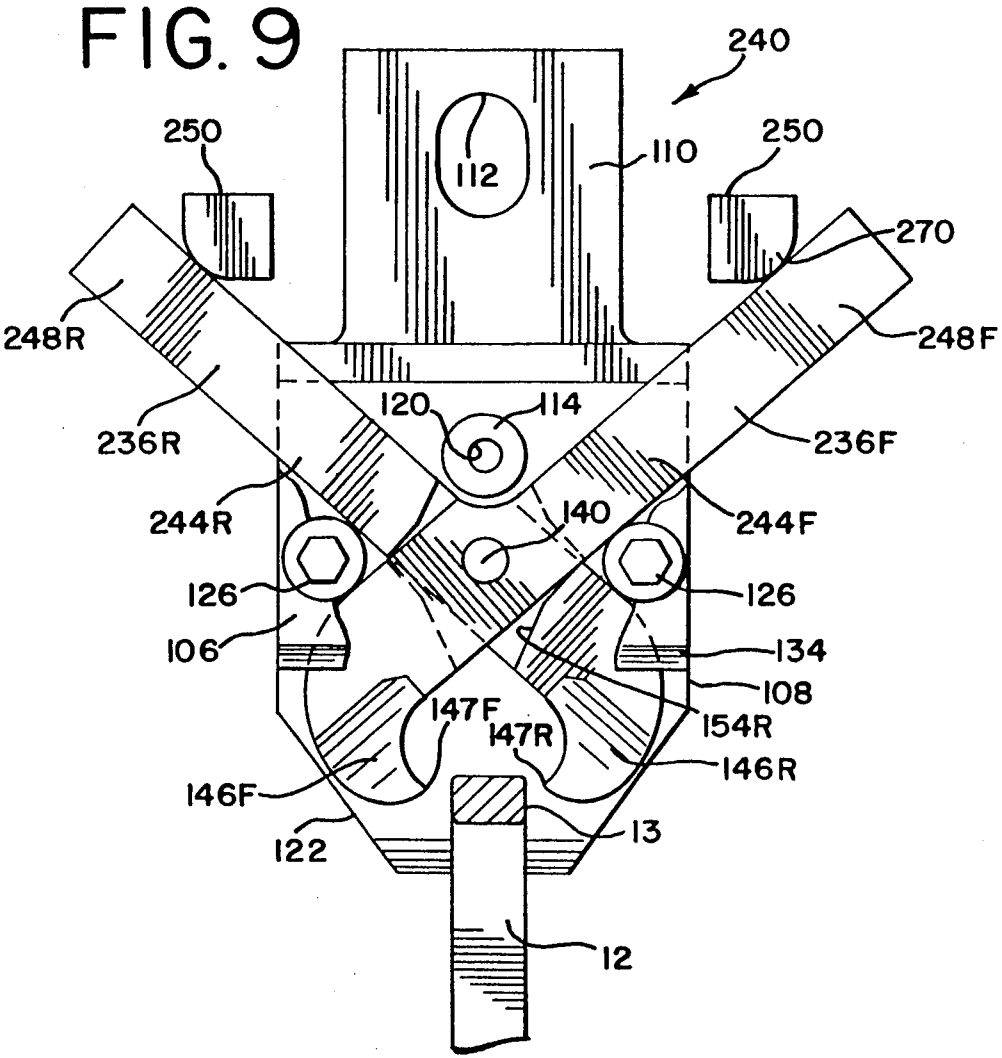
FIG. 9 is a front elevational view, with portions cut away for clarity, of the scissors elements of an alternate embodiment of the hairpin spike pulling tool of FIG. 5.
Figure 11:
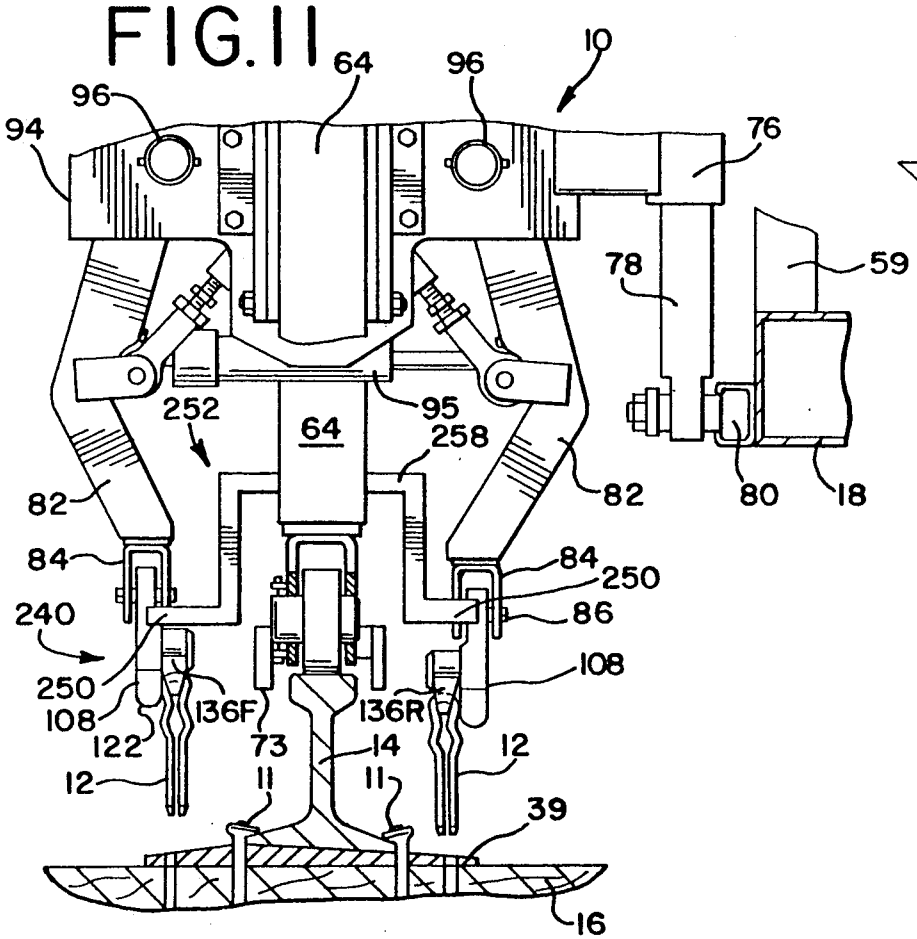
FIG. 11 is an enlarged partial front elevational view of the hairpin spike pulling machine of FIG. 1, including the embodiment of FIGS. 9 and 10.

Referring now to FIGS. 9–11, an alternate embodiment of the hairpin spike tool is illustrated, and will be referred generally to as 240. The hairpin spike pulling tool 240 is substantially identical to the tool 40 with two major exceptions. The first is that the cylinder 158 has been eliminated, along with the return spring 170, the wings 128 and other attendant structure. The tool 240 thus releases the spikes 12 without supplemental power assist.

The other major are in which the tool 240 differs from the tool 40 is that the upper ends of the arms 144F, 144R of each of the scissors elements 136F, 136R have been reshaped as will be discussed below. The components of the hairpin spike pulling tool 240 which are identical to those of the tool 40 have been designated with identical reference numerals.

The scissors elements 236F and 236R are each provided with a respective arm 244F, 244R which has an upper end 248F, 248R extending outwardly in an angled direction relative to the housing back plate 108 and substantially coaxial with the body of the corresponding scissors element. The ends 248F, 248R extend a distance beyond the outer peripheral edge of the housing back plate 108 which is sufficient to enable the engagement of the ends by at least one laterally projecting arm 250 of a hairpin pulling tool release bracket 252.

The release bracket 252 includes a horizontally disposed, generally "U"-shaped portion 254 including a pair of arms 250 each attached to a base member 256. An "L"-shaped member 258 connects the "U"-shaped portion 254 to the vertical frame member 64, and has a vertical leg 260 and a horizontal leg 262. The horizontal leg 262 is secured to an adjusting plate 264 which is slidably adjustable along a frame member 266 which, in turn, is horizontally secured between vertical frame members 64 and **64*a*. Slots 268 in the adjusting plate 264 are designed to accommodate fasteners (not shown) which releasably secure the plate to the frame member 266**.

Arms 250 of the release bracket 252 are provided in a length and orientation which is sufficient to engage the tool 240 regardless of the at-rest position of the corresponding support arm 82 of the machine 10 as shown in FIG. 11. Further, the lower outside corners 270 of each of the arms 250 have a rounded or radiused profile to minimize friction and abrasion through engagement with the upper ends 248F, 248R of the scissors elements 236F, 236R.

Once the tool 240 has pulled a spike 12 from the tie 16, the support arm 82 raises the tool vertically until the upper ends 248F, 248R of the arms 244F, 244R impact the arms 250 of the release bracket 252. This impact causes the arms 244F, 244R to pivot about the pivot pin 140 and to open, thus releasing the spike 12.

Figure 12:
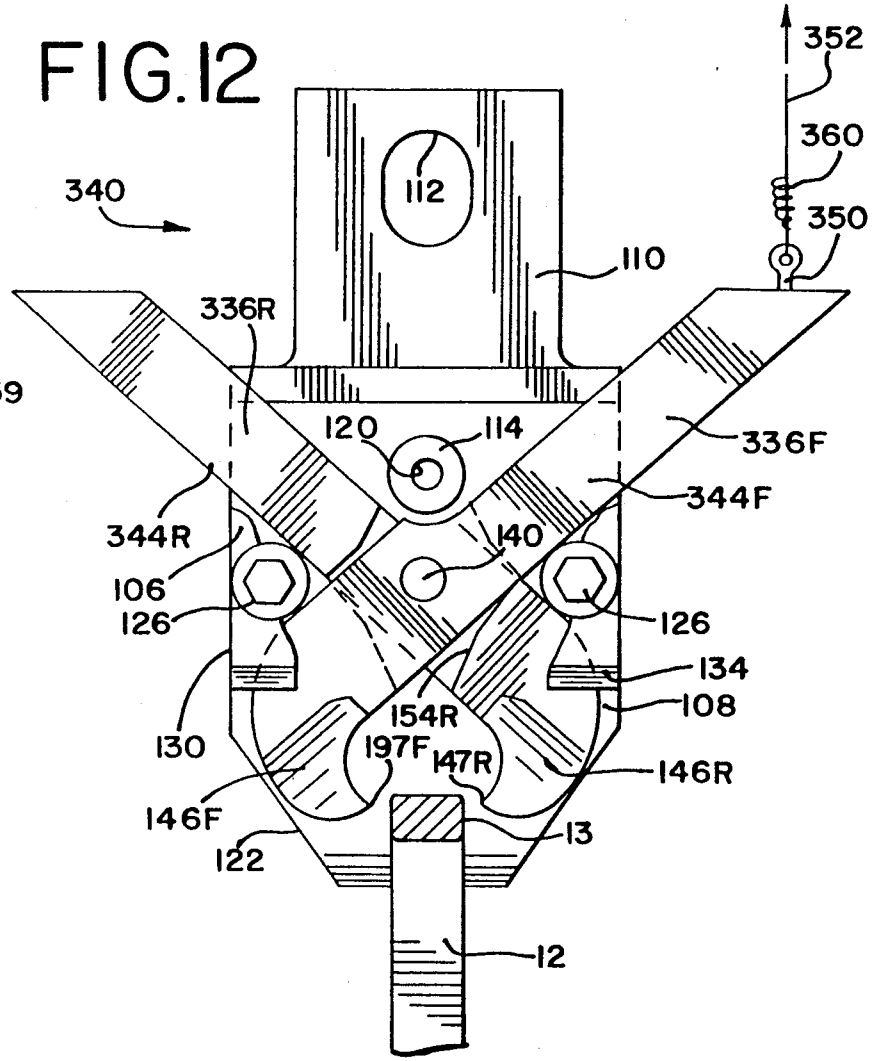
FIG. 12 is a front elevational view, with portions cut away for clarity, of the scissors elements of another alternate embodiment of the hairpin spike pulling tool of FIG.
Figure 13:
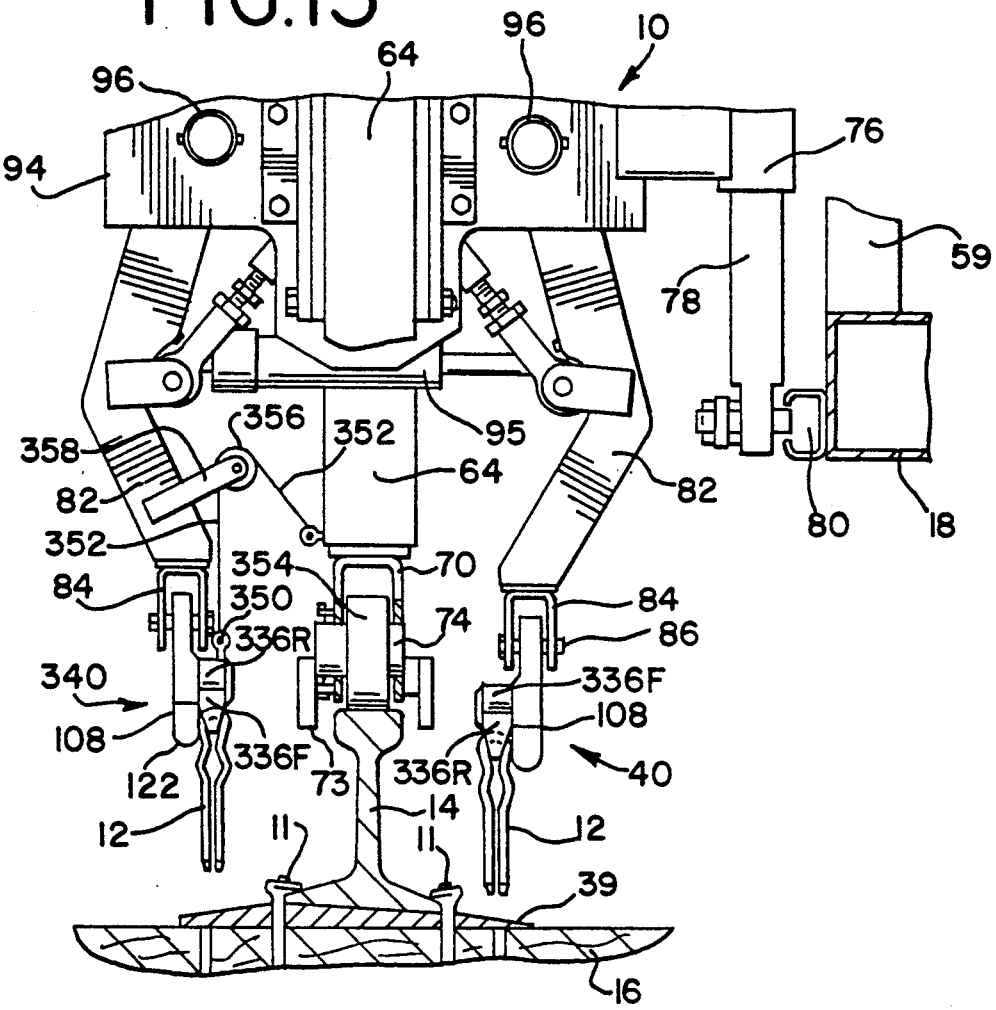
FIG. 13 is an enlarged partial front elevational view of the hairpin spike pulling machine of FIG. 1, including the embodiment of FIG. 12.

Referring now to FIGS. 12 and 13, another embodiment of the hairpin spike pulling tool 40 is illustrated, and will be designated 340. The tool 340 is similar to the tool 240 in 10 that the hydraulic cylinder 158, the return spring 170, the wings 128 and other attendant structure have been eliminated. The tool 340 thus releases the spikes 12 without supplemental power assist. As was the case with the tool 240, those components of the hairpin spike pulling tool 340 which are identical to those of the spike pulling tool 40 have been designated with identical reference numerals.

The tool 340 includes a pair of scissors elements 336F, 336R, each having an arm 344F, 344R are similar in configuration to the arms 244F, 244R of the pulling tool 240 in that upper ends 348F, 348R project outwardly from the outer peripheral edge of the housing back plate 108. The tool 340 differs in that at least one of the arms 344F, 344R is provided with a first eyelet 350. In all other respects, the hairpin pulling tool 340 is substantially identical to the tool 240.

A cable 352 is connected between the first eyelet 350 and a second eyelet 354 located on the vertical frame member 64. A pulley 356 is freely rotatable on a bracket 358 mounted to at least one of the support arms 82. The bracket is secured to the support arm 82 and projects in a general direction toward the vertical frame member 64. Although only one bracket 358 and pulley 356 is depicted, it is contemplated that both arms 82 will be provided with a bracket and pulley to enable spikes 12 to be removed from either side of the rail 14.

The cable 352 is passed around the pulley 356 prior to attachment to either or both of the eyelets 350, 354. In view of the connection of at least one of the arms 344F, 344R to the frame 18, it will be evident that upon the exertion of a sufficient pulling force, the arm 344F, 344R connected to the cable 352 will be drawn upward, causing a pivoting action of the arm about the pivot pin 140, and the release of the held spike 12. If desired, a tension spring 360 (best seen in FIG. 12) or other tension adjusting device may be connected to the cable 352.

In operation, as the support arm 82 is manipulated by the operator to swing down upon a hairpin spike 12 and, in the case of the tool 40, the operator pressurizes the cylinder 158 to spread the hooks 146F, 146R to place the tool 40 in the open position. In all of the embodiments, the depending configuration of the lower end 122 of the back plate 108 acts as a backstop in that it contacts the loop-shaped head 13 of the spike 12 and, in cooperation with the open position of the hooks, facilitates the "finding" of the spike head 13 by the tool 40 and prevents inefficient overshooting. In the embodiments 240 and 340, the hooks 146F, 146R are normally closed, and the spike head 13 is "found" by the shape of the lower edges of the hooks and the backstop function of the back plate 108. The guard formations 128 on the housing face plate 106 are provided to protect the hydraulic cylinder 158 and the scissors elements 136F, 136R from impact damage.

It is to be noted that the dimensional configuration of the elements within the hairpin spike pulling tool 40 (as well as the tools 240 and 340, although for simplicity, only the tool 40 is described) is such that there is an intentional "sloppiness" in the fit of the scissors elements 136F, 136R within the confined space between the face plate 106 and the back plate 108. This intentional sloppiness allows the scissors elements 136F, 136R to move freely between the face plate and the back plate so that the curved hooks 146F, 146R may seek and find a nearby hairpin spike 12 when the arm 82 of the machine 10 moves downwardly in order to bring the pulling tool 40 into engagement with a hairpin spike.

This means that the distance by which the bearing pins 114, 116, 118 project from the back plate 108 is sufficient to provide the confined space with a greater depth than the thickness of the two joined scissors elements 136F, 136R, thereby allowing the scissors elements to freely move back and forth between the face plate and the back plate, to seek and find the loop-shaped head 13 of the hairpin spike 12. Thus, this "sloppiness" of the fit of the scissors elements 136F, 136R between the face plate and the back plate, and in relation to each other, allows the scissors elements to seek and find the hairpin spike with minimal manual intervention by a human operator.

To optimize the engagement of the loop-shaped head 13 of the spike 12, the distance between the lower end 122 of the back plate 106 and the tip of the hook 146F, 146R, is one-half the diameter of the loop-shaped head 13. Engagement of the spike 12 by the tool 40 is also facilitated by the loose mounting of the flat bracket 110 in the clevis 84 due to the elongated aperture 112.

In the preferred embodiment of spike pulling tool 40, once the lower end 122 engages the spike head 13, the inward pivot swing of the support arm 82 under the control of the cylinder 95 is prevented, and, in the tool 40 only, the arm control mechanism monitors any increase in pressure normally through a pressure switch (not shown). Once the monitored pressure increases beyond a specified limit, the pressure to the cylinder 158 is released, and the spring 170 pulls the hooks 146F, 146R together around the loop-shaped spike head 13. Alternately, the depressurization of the cylinder 158 may be under operator control. If the spike 12 is "high", or sticking vertically out of the tie plate 39, the vertical play of the scissors elements 136F, 136R within the space defined between the housing face plate 106 and the back plate 108 facilitates proper engagement of the loop-shaped spike held 13 by the hooks 146F, 146R.

Once the hooks are securely engaged in the loop-shaped spike head 13, the spike 12 is ready for extraction from the tie 16. Extraction of spikes by the machine 10 is basically accomplished as described in U.S. Pat. No. 4,538,793, which has been incorporated by reference. This is accomplished by a signal to the cylinder 104 which raises the support block 94 on the second frame 62, as well as the support arms 82, to accomplish the spike extraction. In all embodiments, due to the loose arrangement of the scissors elements, increased vertical extraction force exerted by the support arm 82 tightens the gripping force of the scissors elements around the spike. A limit switch (not shown) located on the second frame 62 senses the vertical position of the support block 94, and when the block reaches the upper limit of its travel, the cylinder 158 is repressurized to open the hooks 146F, 146R and release the spike 12.

While elevated on the frame 62, the hooks 146F, 146R remain in the open position to stay clear of obstacles such as tie plates, rail anchors, etc. located on the rail track bed. When the spike extraction cycle is to be repeated, the cylinder 104 lowers the support block 94 and the support arms 82 to a position in close proximity to the rails 14, and the machine 10 is moved along the rail to the next spike 12 to be extracted. As the machine 10 moves down the rails 14, undamaged spikes may then be collected for reuse, while damaged spikes may be collected as scrap metal.

In situations when the cylinder 158 is not provided, the downward pressure of the tool 40, as well as the tools 240 and 340, upon the spike head 13 is enough to temporarily spread the hooks 146F, 146R to engage the spike as shown in FIG. 6.

To release the spike in applications where the cylinder 158 is not provided, the spike is released by lowering the support arms 82 until the spike may be "pushed" or "bounced" upon the ground. This impact forces the spike head 13 against the bearing pin 114, causing the hooks 146F, 146R to separate, releasing the spike.

In the case of the spike pulling tool 240, as the support arm 82 pulls upward, the spike is withdrawn. As the withdrawn spike is raised above the tie 16, the upper ends 248F, 248R will contact the arms 250 of the tool release bracket 252, causing the scissors elements 236F, 236R to pivot about the pivot pin 140, releasing the spike. Once the spike 12 is released, the scissors elements 236F, 236R close of their own weight.

Referring to the spike pulling tool 340, the spike 12 is "found" and withdrawn in similar fashion to the tool 240. However, in the tool 340, as the support arm 82 pulls the tool 340 and the spike 12 upward, the cable 352 becomes taut, and eventually pulls the arm 344F (connected to the cable) upward to pivot about the pivot pin 140, opening the hooks 146F, 146R and releasing the spike. The hooks then close of their own weight.

Although only two embodiments of the type in which the grip of the scissors elements 236, 336, is released upon contact with the frame 18, it is contemplated that other equivalent non-powered mechanisms for spike release in this fashion may be substituted to achieve the same effect.

One advantage of the present spike pulling tool 40 is that in the closed position, a combination of the loose fit of the arms 144F, 144R in the housing 106, 108 and against the pins 114, 116, 118 exerts a stronger gripping force upon the spike 12 as the extraction force is increased. Moreover, this is accomplished without the use of supplemental power sources, as are required in some prior spike extraction devices.

Another advantage of the present spike pulling tool is that it is multi-functional, in that it mechanically locates, grasps and releases the spikes, often without the provision of supplemental power devices. This feature also reduces overall stress on the machine 10.

It is to be noted that a feature of the hairpin spike pulling tool 40 of the present invention provides economy of manufacture and ease of fabrication and assembly. For example, the entire tool 40 may be assembled and disassembled by the manipulation of three fasteners. Additionally, the two scissors elements can be disassembled for repair by removal of a single pivot pin. It is also to be noted that the front and rear scissors elements may be provided as a single element in which two identical pieces are brought into a face-to-face opposing relationship.

Although the present invention has been described with preferred embodiments illustrated herein, it is to be understood that modifications and variations may be resorted to without departing from the spirit and scope of this invention. Such modifications and variations are considered to be within the purview and scope of the appended claims.

What is claimed is:

1. A hairpin spike pulling tool for engagement in a spike pulling machine for use in removing a railroad hairpin spike out of a railroad tie supporting a rail of a railroad track, the spike pulling machine including a machine frame, wheels for supporting the machine frame for movement along railroad tracks, an engine supported by the machine frame for driving at least one of the wheels, and apparatus for supporting each said pulling tool or movement from a retracted position downwardly and toward the hairpin spike into a position wherein said pulling tool engages the spike and then moves upwardly to pull the spike from the tie, wherein the hairpin spike includes a loop-shaped head defining a loop-aperture above the surface of the railroad tie, said pulling tool comprising:

housing means for mounting said tool to the machine;

first and second scissors elements each having a hook at a lower end, said elements being engaged in said housing means and configured for pivotal movement relative to each other so that said hooks are abutted against each other and are movable for engaging the loop-shaped head of the hairpin spike;

means disposed on said tool for moving said hooks into an open position;

each of said scissors elements having an upper end, and said means for moving including a fluid power cylinder having a blind end and a rod end, said blind end connected to one of said upper ends, and said rod end having a shaft connected to the other of said upper ends;

means for biasing said hooks into abutting relationship including a spring connected between said upper ends of said scissors elements for returning said hooks to the closed position upon the release of pressure in said fluid power cylinder.

2. The hairpin spike pulling tool according to claim 1 further including means for attachment to the spike pulling machine for vertically reciprocating said pulling tool.

3. The hairpin spike pulling tool according to claim 2 wherein said attachment means includes a back plate which comprises said housing means.

4. The hairpin spike pulling tool according to claim 3 wherein said attachment means is an elongate mounting aperture in said back plate which is dimensioned for a loose connection to the spike pulling machine, and provides for vertical movement of said tool relative to the machine.

5. The hairpin spike pulling tool according to claim 1 wherein each scissors element contains a transverse channel cutout portion, each scissors element is loosely contained within said channel cutout portion of the other scissors element, and a pivot pin element passes through each scissors element at said channel cutout portion.

6. The hairpin spike pulling tool according to claim 5 wherein said channel cutout portions and said pivot pin element are located below an upper central bearing pin and between lower left and lower right bearing pins located on said housing means.

7. The hairpin spike pulling tool according to claim 1 wherein said housing means has a back plate with a lower end configured as a backstop.

8. The hairpin spike pulling tool according to claim 1 wherein each of said hooks has a lower surface which is configured for locating the head of a hairpin spike.

9. A hairpin spike pulling tool for use on a spike pulling machine in removing a railroad hairpin spike out of a railroad tie supporting a rail of a railroad track, wherein the hairpin spike includes a loop-shaped head defining a loop-aperture above the surface of the railroad tie, the spike pulling machine including a machine frame, wheels for supporting the machine frame for movement along railroad tracks, an engine supported by the machine frame for driving at least one of the wheels, and apparatus for supporting each said pulling tool for movement from a retracted position downwardly and toward the hairpin spike into a position wherein said pulling tool engages the spike and then moves upwardly to pull the spike from the tie, the apparatus including a pair of pivotable support arms, said pulling tool being connectable to a corresponding one of the support arms and comprising:

a. a housing face plate having a front surface and a back surface;

b. a housing back plate having a back surface and a front surface spaced from the back surface of said housing face plate by a plurality of spaced bearing pins, said back plate including an elongate mounting aperture for providing a loose connection between said pulling tool and the respective support arm;

c. securing means holding said face plate back surface abutted against at least two of said bearing pins to thereby provide a confined space between said face plate back surface and said back plate front surface; and d. a front scissors element pivot alloy engaged with a rear scissors element, each of said scissors elements including an elongated arm terminating at its lower end in a hook curving toward the center of said face plate, with said scissors elements being pivotally operable within said confined space and further confined by said bearing pins, and with the lower end of each arm projecting below said face plate so that said curved hooks are abutted against each other below and centrally of said face plate, said arms being movable to close said abutted curved hooks for engaging the loop-aperture for pulling the hairpin spike out of a railroad tie in which it is secured, the subsequent opening of said hooks releasing said spike.

10. The hairpin spike pulling tool according to claim 9 wherein said bearing pins are cylindrical, their front faces are circular, and their cylindrical sides provide bearing surfaces for the upper lengths of the arms of said scissors elements.

11. The hairpin spike pulling tool according to claim 9 wherein said bearing pins are fixedly mounted on said back plate front surface.

12. The hairpin spike pulling tool according to claim 9 wherein said housing means has a back plate with a lower end configured to depend below said hooks for engaging the loop-shaped head of the spikes to assist said hooks in engaging the spike.

13. A scissors element for a hairpin spike pulling tool configured for use in a railroad spike pulling machine in removing a railroad hairpin spike out of a railroad tie supporting a rail of a railroad track, wherein the hairpin spike includes a loop shaped head defining a loop-aperture above the surface of the railroad tie, the spike pulling machine including a machine frame, wheels for supporting the machine frame for movement along railroad tracks, an engine supported by the machine frame for driving at least one of the wheels, and apparatus for supporting each said pulling tool for movement from a retracted position downwardly and toward the hairpin spike into a closed position wherein said pulling tool engages the spike and then moves upwardly to pull the spike from the tie, said scissors element being pivotally matable with a like scissors element in front-to-back fashion by means of a pivot element, said scissors element comprising an elongated arm having a linear axis and terminating at its lower end in a hook curving toward the center of the pulling tool, the arm also having an upper end portion which is angled relative to the linear axis of the arm so that the upper end portion is generally horizontal when the scissors elements are in the closed position, said scissors element being secured within the pulling tool by having a portion of the upper length of its arm loosely extending between and above an upper bearing pin and a lower bearing pin, and with the lower end of said arm projecting below the bearing pins, so that said curved hook is abuttable against the hook of the like scissors element below and centrally of the pulling tool bearing pins due to the weight of said scissors element and the like element and their loose fit between the bearing pins, to be freely abutted against each other within the loop-aperture of the hairpin spike head, so that raising the spike pulling tool upwardly causes said abutted curved hooks to then pull the hairpin spike out of a railroad tie in which it is secured.

* * * * *

UNITED STATES PATENT AND TRADEMARK OFFICE

CERTIFICATE OF CORRECTION

PATENT NO. : 5,253,844

DATED : October 19, 1993

INVENTOR(S) : Dennis J. Cotic and Jack K. Hosking

It is certified that error appears in the above-identified patent and that said Letters Patent is hereby corrected as shown below:

Column 2, line 65, delete "cause" and insert --causes--;
Column 3, line 21, after "spike" insert --.--;
Column 4, line 43, delete "FIG." and insert --FIG. 5;--;
Column 4, line 50, delete "FIG. I" and insert --FIG. 1--;
Column 6, line 9, delete "ca" and insert --can--;
Column 8, line 65, delete "36F" and insert --136F--;
Column 8, line 68, after "portion" delete ".";
Column 10, line 39, delete "are" and insert --area--;
Column 11, line 19, after "in" delete "10"; and
Column 12, line 56, delete "held" and insert --head--.

In the Claims:

Column 14, line 22, delete "or" and insert --for--; and
Column 15, line 43, delete "pivot alloy" and insert --pivotally--.

Signed and Sealed this

Tenth Day of January, 1995

*Attest:*

Bruce Lehman

BRUCE LEHMAN

*Attesting Officer*

*Commissioner of Patents and Trademarks*